US007174729B2

(12) United States Patent
Cushman et al.

(10) Patent No.: US 7,174,729 B2
(45) **Date of Patent: *Feb. 13, 2007**

(54) AUTOMATIC DEFROST CONTROLLER INCLUDING AIR DAMPER CLEANING

(75) Inventors: Robert L. Cushman, Sparta, MI (US); Stephen Ruedger, Grand Rapids, MI (US)

(73) Assignee: Electrolux Home Products, Inc., Cleveland, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/235,755

(22) Filed: Sep. 27, 2005

(65) Prior Publication Data

US 2006/0021365 A1 Feb. 2, 2006

Related U.S. Application Data

(63) Continuation of application No. 10/643,388, filed on Aug. 19, 2003.

(51) Int. Cl.
*G05D 23/32* (2006.01)

(52) U.S. Cl. ..... 62/157

(58) Field of Classification Search ..... 62/155–157, 62/186, 187, 180, 419, 314; 137/625.3
See application file for complete search history.

(56) References Cited

U.S. PATENT DOCUMENTS 3,421,338 A 1/1969 Gidseg
3,486,347 A 12/1969 Gidseg
3,645,108 A * 2/1972 Houk ..... 62/187
3,845,637 A 11/1974 Shepherd
4,013,434 A 3/1977 Kronenberger et al.
4,276,754 A * 7/1981 Ty ..... 62/187
4,445,912 A 5/1984 Volk et al.
4,688,393 A * 8/1987 Linstromberg et al. ..... 62/187
4,689,966 A 9/1987 Nonaka
4,735,057 A * 4/1988 Janke ..... 62/187
4,819,442 A * 4/1989 Sepso et al. ..... 62/187
4,852,361 A 8/1989 Oike
4,903,501 A 2/1990 Harl
4,924,680 A 5/1990 Janke et al.
5,154,045 A 10/1992 Saruwatari et al.
5,201,888 A 4/1993 Beach, Jr. et al.
5,251,454 A 10/1993 Yoon
5,375,413 A * 12/1994 Fredell et al. ..... 62/187
5,477,699 A 12/1995 Guess et al.
5,490,395 A 2/1996 Williams et al.
5,711,159 A 1/1998 Whipple
5,867,994 A 2/1999 Kopko
5,996,361 A 12/1999 Bessler et al.

(Continued)

FOREIGN PATENT DOCUMENTS

JP 11-3511725 A * 12/1999

*Primary Examiner*—Mohammad M. Ali
(74) *Attorney, Agent, or Firm*—Pearne & Gordon LLP

(57) ABSTRACT

A damper cleaning apparatus for a two compartment refrigerator having a damper for controlling airflow between compartments. The damper cleaning apparatus includes a damper drive mechanism for opening and closing the damper. A controller for controlling the damper drive mechanism repeats a cleaning operation at a set interval. The cleaning operation includes plural repetitions of at least partially opening the damper and then at least partially closing the damper. Optionally, the controller waits for the defrosting apparatus to be turned off and then subsequently performs the cleaning operation.

10 Claims, 2 Drawing Sheets

U.S. PATENT DOCUMENTS 6,055,820 A 5/2000 Jeong et al.
6,125,641 A 10/2000 Kim et al.
6,557,362 B1 * 5/2003 Wilson ..... 62/187
6,609,774 B2 * 8/2003 Banicevic et al. ..... 312/330.1
6,622,504 B2 9/2003 Lee et al.
6,694,758 B1 2/2004 Cho et al.
6,739,146 B1 * 5/2004 Davis et al. ..... 62/155
6,769,263 B1 * 8/2004 Armour et al. ..... 62/187
6,779,353 B2 8/2004 Hu et al.

* cited by examiner

AUTOMATIC DEFROST CONTROLLER INCLUDING AIR DAMPER CLEANING

CROSS-REFERENCE TO RELATED APPLICATION

The present application claims the benefit of U.S. patent application Ser. No. 10/643,388 filed Aug. 19, 2003, which is incorporated herein by reference.

BACKGROUND OF THE INVENTION

The present invention relates to automatic defrost controls for two compartment refrigerators, and more particularly to automatic defrost controllers including air damper control.

Refrigerators having two refrigeration compartments, including a fresh food compartment and a frozen food compartment, are well known. Many of these two compartment refrigerators have refrigeration apparatus connected to the frozen food compartment and a duct for carrying cool air from the frozen food compartment to the fresh food compartment. In order to regulate the temperature of the fresh food compartment, a damper or baffle is often provided within or adjacent to the duct. The baffle is thermostatically controlled to provide a desired temperature within the fresh food compartment.

Self defrosting refrigerators generally include a defrost heater for melting ice that has accumulated on the refrigeration apparatus. However, the operation of the defrost heater will often cause water to accumulate on or near the air duct damper. Subsequently, especially when the cooling apparatus is operated, the water can freeze and form ice that interferes with the effective operation of the damper.

In order to avoid this problem, a number of solution has been proposed. In U.S. Pat. No. 5,201,888 to Beach et al. a control moves the damper to a fully closed position while energizing the defrost heater. Thus, the formation of condensation and subsequent ice formation is reduced. However, water can still accumulate on the baffle, which later freezes, especially when the defrost heater must be operated for an extended period of time.

U.S. Pat. No. 5,375,413 to Fredell et al. discloses a two-element sliding air baffle for a refrigerator. The second baffle element is operated by a solenoid that, in a closed position, is periodically pulsed (every one minute) thereby exerting a repeated rocking or leveraging motion on the second baffle member. The rocking motion enhances the break up of any ice that has formed between the two baffle elements. However, once ice has formed, it can be very difficult to remove.

Further, energy conservation is becoming more and more important in appliances such as refrigerators. Although many energy saving measures have been developed, there are significant inefficiencies in the operation of such refrigerators.

Thus, there is a need for a refrigerator capable of preventing the build-up of ice on an air duct damper. Further, there is a need for improving the energy efficiency of refrigerators.

BRIEF SUMMARY OF THE INVENTION

The present invention provides a damper cleaning apparatus for a two compartment refrigerator having a damper for controlling airflow between compartments. The damper cleaning apparatus comprises a damper drive mechanism for opening and closing the damper; and a controller for controlling the damper drive mechanism wherein the controller repeats a cleaning operation at a set interval. The cleaning operation comprises plural repetitions of at least partially opening the damper and then at least partially closing the damper.

According to another aspect, the present invention provides a two compartment refrigerator having a damper for controlling airflow between compartments. The refrigerator comprises a damper drive mechanism for opening and closing the damper; a controller for controlling the damper drive mechanism, wherein the controller performs a cleaning operation by at least partially opening the damper and then at least partially closing the damper; and a defrosting apparatus. The controller waits for the defrosting apparatus to be turned off and then subsequently performs the cleaning operation.

DETAILED DESCRIPTION OF THE INVENTION

Figure 1:
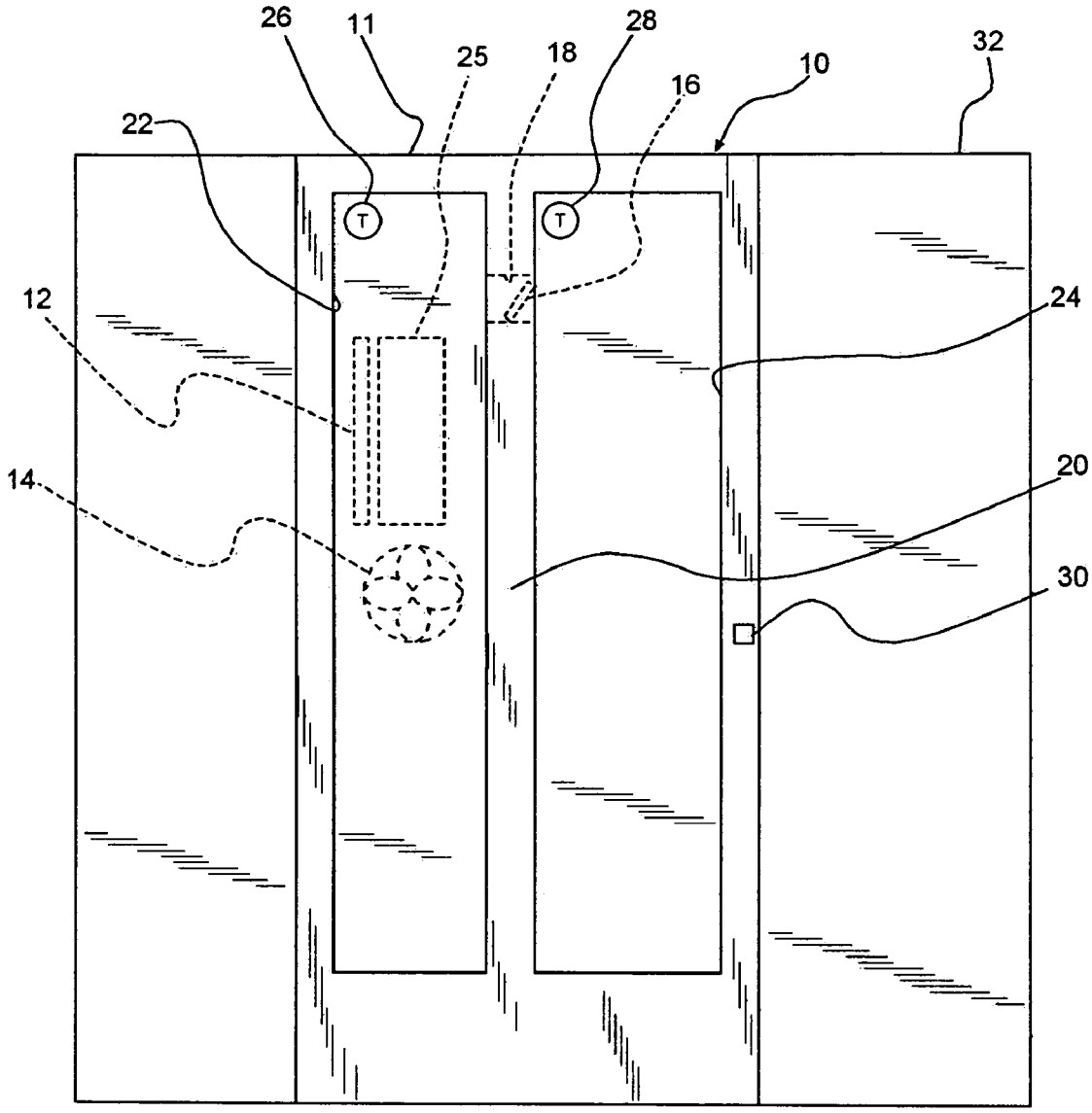
FIG. 1 schematically shows a refrigerator according to an embodiment of the present invention.

As shown in FIG. 1, the present embodiment of the invention provides an automatic defrost controller (ADC) that controls the operation of a defrost heater in a refrigerator 10 having a cabinet 11. The ADC also controls the operation of a defrosting apparatus or defrost heater 12, an evaporator fan 14 and a air damper 16 positioned in an air duct 18 located in a divider wall 20 separating a frozen food compartment 22 and a fresh food compartment 24 of the refrigerator 10. A refrigeration apparatus 25, including a compressor, condenser and evaporator (not separately shown), is controlled by a freezer control or thermostat 26 to maintain the frozen food compartment 22 at a set temperature. A fresh food control or thermostat 28 maintains the fresh food compartment 24 at a set temperature by controlling the opening and closing of the damper 16 and the operation of the evaporator fan 14 to provide cooling air from the frozen food compartment 22 through the air duct 18. The defrost heater 12 is located adjacent to a portion of the refrigeration apparatus, i.e. the evaporator, on which ice forms in order to remove the ice.

Figure 2:
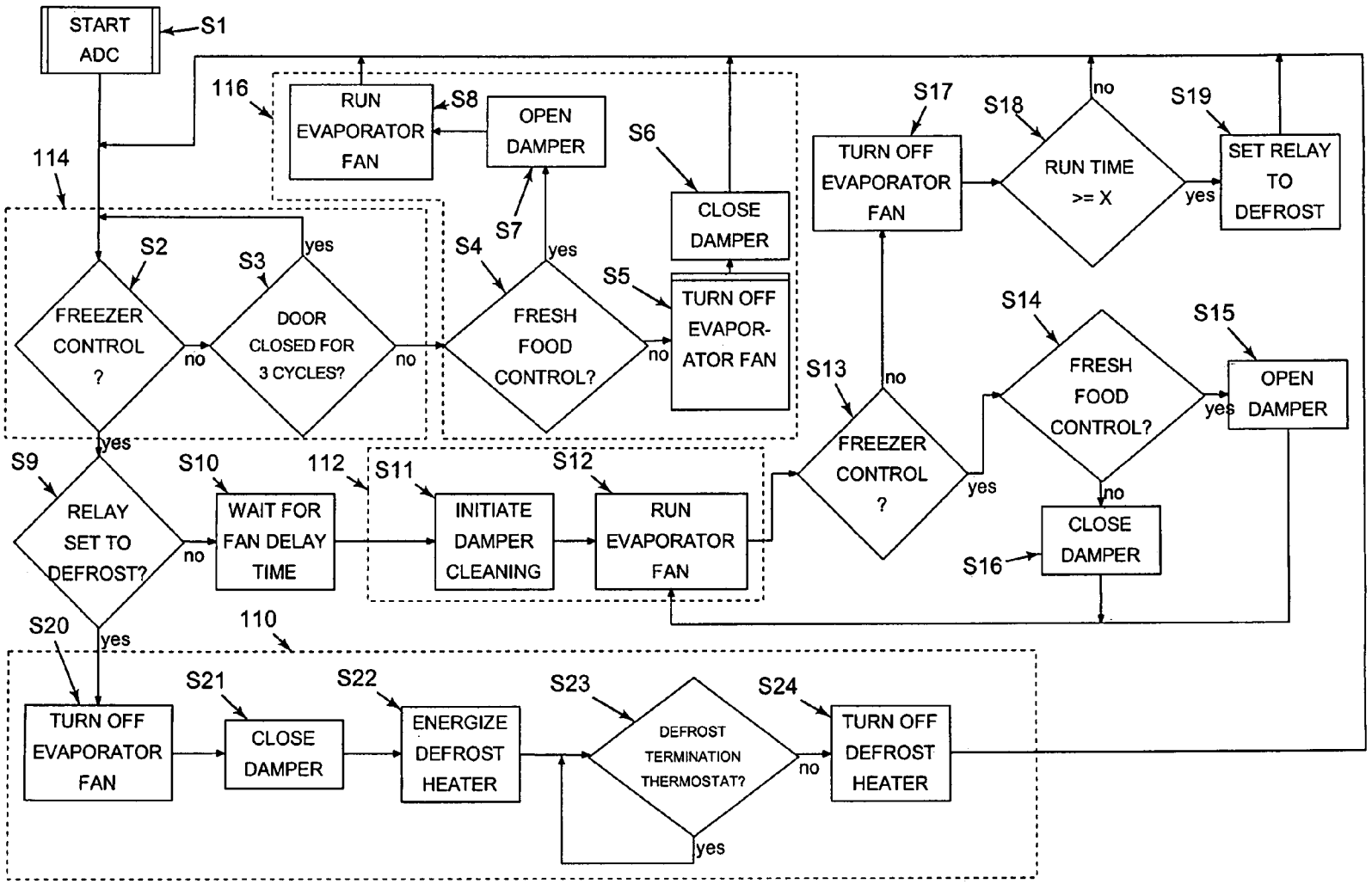
FIG. 2 shows a flow diagram for the operation of a automatic defrost controller according to the present invention.

As shown in FIG. 2, the ADC according to the present embodiment controls the operation of the defrost heater 12 and the other components of the refrigerator as follows. The ADC control flow commences at step S1 when power is provided to the ADC.

At step S2, if the freezer control 26 indicates that no cooling is needed in the frozen food compartment 22 (the compressor is off) control passes to step S3. At step S3, if the ADC determines from a door sensor or switch 30 that the refrigerator door 32 has not been opened for a predetermined number of previous refrigeration cycles or compressor on/off cycles, such as one or three cycles, then the ADC returns to step S2. Otherwise, if the door 32 was opened during the last three cycles, then control passes to step S4.

At step S4, if the fresh food control 28 is not calling for cooling then the ADC turns off the evaporator fan 14 at step S5, closes the damper 16 at step S6 and returns to step S2. Otherwise, if the fresh food control calls for cooling at step S4, the ADC opens the damper at step S7, runs the evaporator fan at step S8 and returns to step S2.

If, at step S2, the freezer control 26 is calling for cooling, control passes to step S9. At step S9, if the defrost relay is not set to defrost, control passes to step S10 where the ADC pauses for a fan delay time to allow the compressor time to begin providing cooling air. Next, at step S11, the ADC initiates a damper cleaning operation, as describe below in more detail, and then passes to step S12 to run the evaporator fan and then pass to step S13.

At step S13, if the freezer control no longer requires cooling (the compressor has stopped), the evaporator fan is turned off at step S17. Next at step S18, if the cumulative compressor run time is greater than or equal to a set defrost interval, X, then the defrost relay is set to defrost at step S19 and control returns to step S2. Otherwise, control returns directly to step S2.

At step S9, if the defrost relay is set to defrost, control passes to step S20. At step S20, the evaporator fan is turned off, the damper is closed at step S21, and the defrost heater is energized at step S22. Next, at step S23, the defrost heater remains energized until a defrost termination thermostat opens in response to reaching a set temperature, indicating that the melting of the frost on the evaporator is complete, at which time control passes to step S24 and the defrost heater is turned off. ADC control then returns to step S2.

As described above and shown in the drawing figure at reference number 110, the ADC turns off the evaporator fan and closes the damper during the operation of the defrost heater. This helps to prevent moisture from collecting on the damper that would subsequently turn into ice and interfere with the operation of the damper.

In order to prevent water that may have accumulated during defrosting from freezing on or near the damper, the ADC periodically performs a damper cleaning operation S11 as described above. During this damper cleaning operation S11, the ADC causes the damper door to open and close a specified number of times at a specified frequency. This movement of the damper causes accumulated water on and near the damper to be removed. As shown in the drawing figure at reference number 112, the damper cleaning operation S11 is initiated just prior to the operation of the evaporator fan S12. In the present embodiment, during the damper cleaning operation, the damper is repeatedly moved to a fully open position and then to a fully closed position. It is contemplated to be within the scope of the present invention that the damper may alternatively be moved to a partially open position and/or a partially closed position during the damper cleaning cycle. The time between openings and closings can be set to any appropriate amount, such as 1 or 2 seconds. Alternatively, the damper can be opened and closed in immediate succession without any delay. The number of open/close cycles can be set to any appropriate amount, such as one or two or more. Alternatively, the number of open/close cycles and/or their timing can be controlled in a closed-loop fashion, such as based on the length of the prior defrost cycle.

Further, the ADC monitors a door switch to determine when the door of the fresh food compartment has been opened. If the compressor goes through a set number of refrigeration cycles or "on/off" cycles, without the door being opened, the damper is kept closed during subsequent compressor "off" cycles. This prevents migration of cold air from the freezer compartment to the fresh food compartment when no cooling has been called for by the freezer control. As shown in the drawing figure at reference number 114, this is accomplished in the present embodiment by bypassing the off-cycle damper control routine 116 when the door has not been opened in the three prior refrigeration cycles S3. It should be appreciated that the number three has been used as an example, and that the number of cycles can be set to any appropriate number, including one, two, four or more. Further, different intervals, other than refrigeration cycles, to determine when to allow the damper to be opened when the compressor is off.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A damper cleaning apparatus for a two compartment refrigerator having a damper for controlling airflow between compartments, the damper cleaning apparatus comprising:

a damper drive mechanism for opening and closing the damper; and a controller for controlling the damper drive mechanism wherein the controller repeats a cleaning operation at a set interval, and wherein the cleaning operation comprises plural repetitions of at least partially opening the damper and then at least partially closing the damper.

2. The damper cleaning apparatus of claim 1 wherein the cleaning operation causes accumulated water on and near the damper to be removed.

3. The damper cleaning apparatus of claim 1 wherein the cleaning operation further comprises waiting a set amount of time between the repetitions of at least partially opening the damper and then partially closing the damper.

4. The damper cleaning apparatus of claim 3 wherein the set amount of time is one of one second or two seconds.

5. The damper cleaning apparatus of claim 3, wherein the set amount of time is determined by the controller in a closed-loop fashion based on the length of a prior defrost cycle.

6. The damper cleaning apparatus of claim 1, wherein during the cleaning operation the damper is opened and closed in immediate succession without any delay.

7. The damper cleaning apparatus of claim 1, wherein the cleaning operation comprises two repetitions of at least partially opening the damper and then at least partially closing the damper.

8. The damper cleaning apparatus of claim 1, wherein the number of repetitions of at least partially opening the damper and then at least partially closing the damper during the cleaning operation is determined by the controller in a closed-loop fashion based on the length of a prior defrost cycle.

9. A two compartment refrigerator having a damper for controlling airflow between compartments, the refrigerator comprising:

a damper drive mechanism for opening and closing the damper;

a controller for controlling the damper drive mechanism wherein the controller performs a cleaning operation by at least partially opening the damper and then at least partially closing the damper; and a defrosting apparatus, wherein the controller waits for the defrosting apparatus to be turned off and then subsequently performs the cleaning operation.

10. The refrigerator of claim 9 wherein the damper cleaning operation is initiated prior to the operation of an evaporator fan.

* * * * *

UNITED STATES PATENT AND TRADEMARK OFFICE

CERTIFICATE OF CORRECTION

PATENT NO. : 7,174,729 B2
APPLICATION NO. : 11/235755
DATED : February 13, 2007
INVENTOR(S) : Cushman et al.

It is certified that error appears in the above-identified patent and that said Letters Patent is hereby corrected as shown below:

Col. 1, Line 34 “solution” should be --solutions--; and
Col. 3, Line 8 “describe” should be --described--

Signed and Sealed this

Twenty-ninth Day of May, 2007

JON W. DUDAS
*Director of the United States Patent and Trademark Office*